US009327808B2

(12) United States Patent
Grimsey

(10) Patent No.: US 9,327,808 B2
(45) Date of Patent: May 3, 2016

(54) BREATHING APPARATUS

(75) Inventor: Peter Grimsey, Teignmouth (GB)

(73) Assignee: GRIMSEY MARINE TECHNOLOGY LIMITED, Teignmouth, Devon (GB)

( * ) Notice: Subject to any disclaimer, the term of this patent is extended or adjusted under 35 U.S.C. 154(b) by 822 days.

(21) Appl. No.: 13/201,763

(22) PCT Filed: Feb. 26, 2010

(86) PCT No.: PCT/GB2010/000345

§ 371 (c)(1),
(2), (4) Date: Aug. 16, 2011

(87) PCT Pub. No.: WO2010/097594

PCT Pub. Date: Sep. 2, 2010

(65) Prior Publication Data

US 2011/0297153 A1 Dec. 8, 2011

(30) Foreign Application Priority Data

Feb. 26, 2009 (GB) ..... 0903320.0

(51) Int. Cl.
*A61M 16/00* (2006.01)
*B63C 11/24* (2006.01)

(52) U.S. Cl.
CPC ..... *B63C 11/24* (2013.01)

(58) Field of Classification Search
None
See application file for complete search history.

(56) References Cited

U.S. PATENT DOCUMENTS

| | | | | | |
|---|---|---|---|---|---|
| 3,802,427 | A | * | 4/1974 | Banjavich et al. | 128/201.25 |
| 3,921,628 | A | | 11/1975 | Smythe et al. | |
| 3,924,616 | A | * | 12/1975 | Banjavich et al. | 128/201.25 |
| 4,109,651 | A | * | 8/1978 | Steigerwald | 128/205.17 |
| 4,141,353 | A | | 2/1979 | Dahlback et al. | |
| 4,339,917 | A | * | 7/1982 | LaGrone | 60/39.281 |
| 4,964,404 | A | * | 10/1990 | Stone | 128/204.22 |
| 5,076,267 | A | | 12/1991 | Pasternack | |
| 5,195,516 | A | * | 3/1993 | Grimsey | 128/204.26 |
| 5,722,454 | A | | 3/1998 | Smith et al. | |
| 6,003,513 | A | * | 12/1999 | Readey et al. | 128/205.24 |
| 6,283,120 | B1 | | 9/2001 | Kellon | |
| 6,302,106 | B1 | * | 10/2001 | Lewis | 128/204.22 |
| 6,341,604 | B1 | * | 1/2002 | Kellon | 128/201.27 |
| 6,895,961 | B1 | * | 5/2005 | Todorov | 128/201.27 |
| 7,066,175 | B2 | * | 6/2006 | Hamilton et al. | 128/205.24 |
| 2009/0188503 | A1 | * | 7/2009 | Brandt | 128/205.12 |

FOREIGN PATENT DOCUMENTS

| | | | |
|---|---|---|---|
| FR | 2 622 459 | A1 | 5/1989 |
| JP | 63-59797 | U | 4/1988 |
| WO | WO 89/01895 | A1 | 3/1989 |

OTHER PUBLICATIONS

International Search Report for Application No. PCT/GB2010/000345 dated Apr. 27, 2011.
Written Opinion for Application No. PCT/GB2010/000345 (undated).

* cited by examiner

*Primary Examiner* — Jason Flick
*Assistant Examiner* — Eric Bryant
(74) *Attorney, Agent, or Firm* — Dority & Manning, P.A.

(57) ABSTRACT

A double counterlung for the breathing circuit of a diver has regulators (41, 51) for automatic addition and venting of breathing gas. Also disclosed is a weighted hinged plate (3) for a double counterlung, to reduce breathing effort when the diver is horizontal. Other improvements to the breathing circuit are described including use of a two stage compressor (151, 155), and single actuator valves for back-up circuits.

14 Claims, 10 Drawing Sheets

Fig6
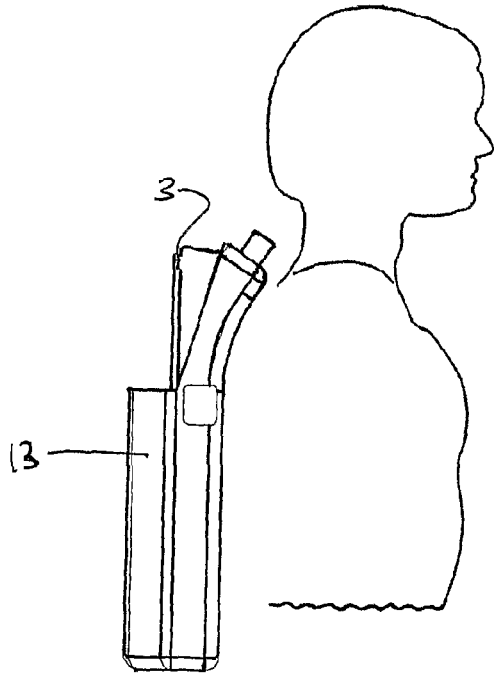
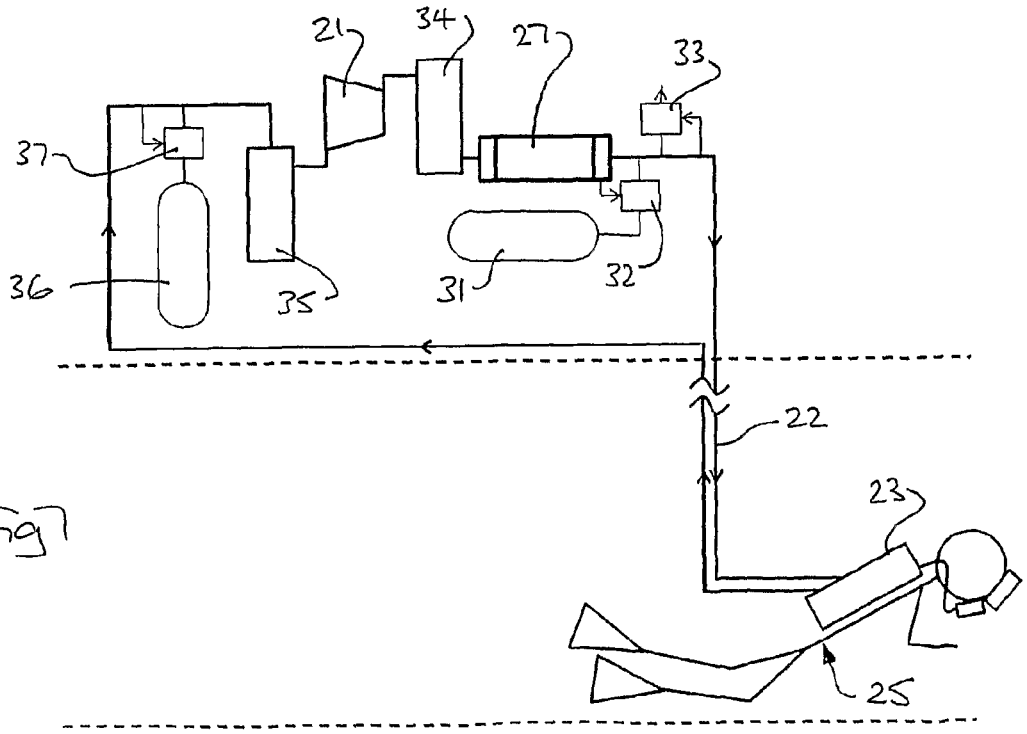
Fig7

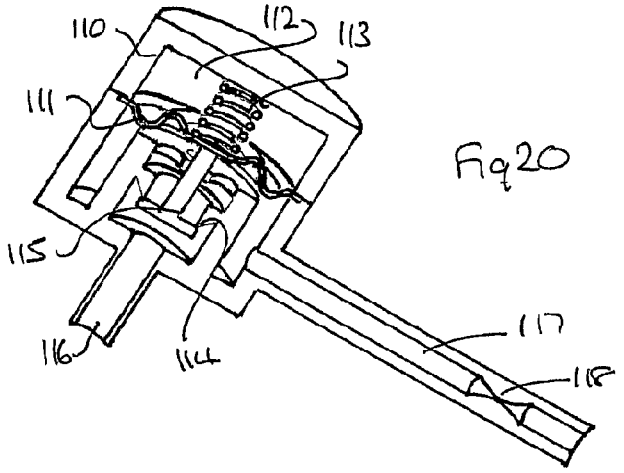
Fig20
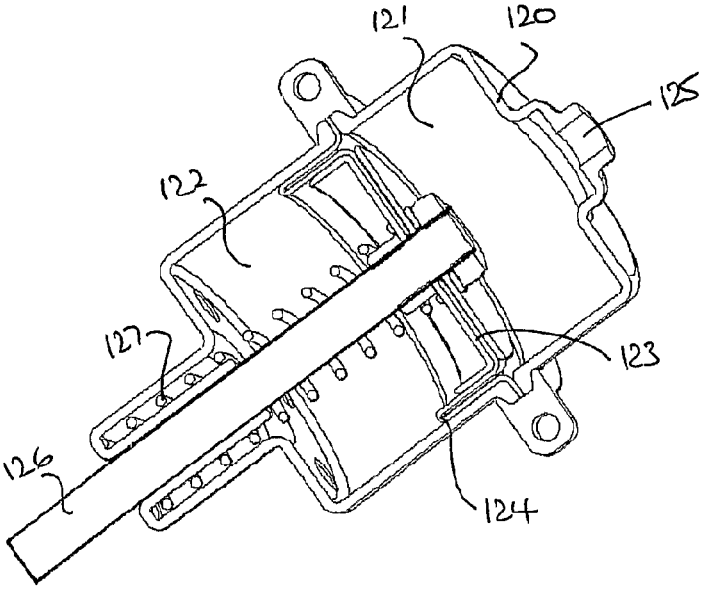
Fig21
Fig22
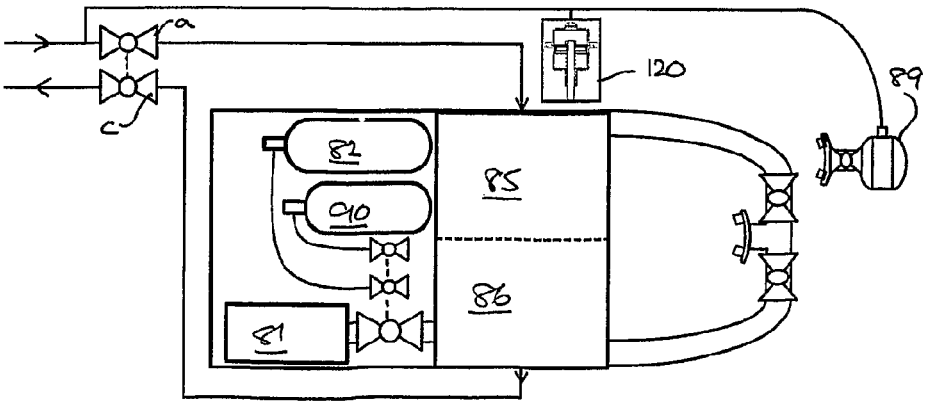

BREATHING APPARATUS

This invention relates to a breathing apparatus particularly, though not exclusively, for use in diving.

WO89/01895 A1 discloses a breathing apparatus for divers in which a double counterlung comprises inlet and outlet chambers joined together in a hinged bellows configuration so as to inflate and deflate together. Shut-off valves isolate the counterlung from the supply circuit when the counterlung in full, and from the return circuit when the counterlung is empty. Relief valves prevent excess pressure or suction on the diver's lungs. The arrangement accommodates fluctuations in flow as the diver breathes, and has the advantages of mechanical simplicity and reliability, among others.

The diver's double counterlung described in WO89/01895 A1 uses a hinged plate to constrain a supply and return counterlung so that they fill and empty together. During normal operation, gas is circulated from the return counterlung to the surface and back down to the diver at a constant rate by a compressor at the surface, typically on a boat. There are no flow or pressure regulators in this breathing circuit so virtually all the pressure drop in the circuit is caused by the umbilical hoses connecting the compressor to the counterlung. The double counterlung compensates for the changes in flow to and from the lungs of the diver as he breathes. The pressure in the breathing circuit at the diver is determined by the pressure acting on the double counterlung. The outlet pressure from the compressor is determined by the pressure at the diver plus the pressure drop in the umbilical supply hose. The inlet pressure to the compressor is determined by the pressure at the diver minus the pressure drop in the return umbilical hose. As the diver descends the pressure in the breathing circuit increases and the gas therein is compressed, so that gas has to be added to the breathing circuit to maintain equilibrium. Gas may also have to be added to compensate for small leaks from the circuit. Similarly as the diver ascends gas needs to be vented from the breathing circuit.

A shortage of gas in the breathing circuit results in there being insufficient gas in the double counterlung, so that it is empty before the diver has finished inhaling. When the counterlung is empty a shut-off valve shuts of the flow of gas from the return counterlung to the return hose and the rate at which the diver can breathe in is limited to the rate at which gas is being supplied to the supply hose from the compressor. Initially this imbalance causes a negligible increase in breathing resistance at the end of inhalation, but as the imbalance increases the double counterlung is empty for longer and the flow of gas from the surface may become insufficient to meet the needs of the diver.

An excess of gas in the breathing circuit results in there being too much gas in the double counterlung so that it is full before the diver has finished exhaling. When the counterlung is full a shut-off valve shuts of the flow of gas from the supply hose and the rate at which the diver can breathe out is limited to the rate at which gas is being drawn back up to the surface through the return hose. Initially this imbalance causes a negligible increase in breathing resistance at the end of exhalation, but as the imbalance increases the double counterlung is full for longer and the flow of gas back to the surface may be insufficient to meet the needs of the diver.

One way of keeping the circuit in balance is to use a pressure regulator and pressure vent valve to add gas to or vent gas from the breathing circuit when the pressure in the circuit at the surface goes outside predetermined limits. The problem with this is that the difference between the upper and lower limits would be relatively small and would need to be adjusted as the depth of the diver changes. Further change would be required should the breathing gas mix be changed. Allowance is required in case the flow coefficients of the various components in the breathing circuit deteriorate over time. Typically, providing an accurate measure of the depth of the diver and the density of the breathing gas is required. Thus the pressure regulator and vent would need constant adjustment while the diver was descending at the beginning of a dive and ascending at the end of a dive, and would need to take into account changes in the composition of the breathing gas.

Typically, two persons are required at the surface to regulate the flow of breathing gas to a diver. A first person monitors actual diving depth, and a second manages the addition and venting of diving gas according to depth and other factors.

What is required is an improved means of detection to allow gas to be added to, or vented from, the breathing circuit as the demand of the diver changes.

According to a first aspect of the invention there is provided a double counterlung breathing circuit comprising a supply duct, a return duct and a source of breathing gas, said circuit including means to detect minimum volume of the counterlung and, in response to add gas from said source to said breathing circuit. Said means may comprise a flow sensor responsive to changes in flow rate in the return duct, but preferably comprise a pressure sensor in the return duct to detect a change in pressure in the breathing circuit. Such a sensor regulator may be a pressure regulator and termed a 'top-up' regulator.

According to a second aspect of the invention, there is provided a double counterlung breathing circuit comprising a supply duct, a return duct, and a vent, said circuit including a means to detect maximum volume of said counterlung and, in response to vent gas from said breathing circuit. The means may comprise a flow sensor in the supply duct, similar to that for detecting minimum volume of the counterlung, but preferably comprises a pressure sensor in the supply duct to detect changes in pressure in the supply duct. Such a sensor may be a pressure regulator and termed a 'Venting' regulator. The venting regulator may include the vent. The top-up and venting regulators may be unitised, for example in a common housing.

The top-up and venting regulator(s) may in practice respond to a rapid change of pressure consequent upon activation of closure valves of the counterlung at maximum and minimum volume thereof. Typically gas is shut-off from the return hose as the counterlungs empty at the end of inhalation, and from the supply hose as the counterlung becomes full at the end of exhalation. The closure of such shut-off valves causes cessation of flow and a detectable pressure change, and one or more pressure detectors may be provided to detect such change and thereby signal said regulator(s).

The gas may be added to the counterlung breathing circuit over one or more breathing cycles.

The top-up and venting regulators automatically add breathing gas to the breathing circuit when there is not enough, or release gas from the breathing circuit when there is too much, regardless of the diver's depth. This avoids the need for manual intervention during normal operation.

The two regulators are preferably situated on the surface so that the "top up" regulator is close to a source, such as gas storage cylinders, and so that the gas from the "Venting" regulator can be collected for reprocessing. In this latter respect another aspect of the invention may further include means to collect vented gas for re-use in said breathing circuit.

Thus detection of when the counterlung is full or empty is proposed, rather than having to calculate an optimum pressure in the system, and add or vent gas by means of a manual intervention.

The volume of breathing gas to be added or vented is determined according to the internal volume of the breathing circuit including double counterlung, supply and return ducts, gas reprocessing unit and compressor, the rate that gas leaks from the counterlung breathing circuit, the change in depth of the diver and other associated factors.

The diver's double counterlung described in WO89/01895 A1 uses a hinged plate to constrain a supply and return counterlung so that they fill and empty together. This design exhibits significant hydrostatic imbalance when the double counterlung is in a backpack and the diver is in a horizontal position. This imbalance is caused by the difference in pressure that the water exerts on the diver's lungs and pressure that the water exerts on the double counterlung when they are at different depths in the water. When the diver is upright the counterlungs are approximately at the same depth as the diver's lungs but when the diver is prone the diver's lungs are up to 250 mm deeper than the counterlungs and this makes it harder for the diver to breathe in gas from the supply counterlung. Similarly if the diver is on his back the counterlungs are up to 250 mm deeper than the diver's lungs, making it harder for the diver to exhale gas into the return counterlung.

Relief valves fitted to prevent excessive pressure or suction on the lungs are also influenced by where they are mounted with respect to the lungs and to the orientation of the diver. The opening pressure measured at the lungs will be higher when the relief valves are deeper than the lungs and lower when the lungs are deeper than the relief valves.

What is required is a means and method of alleviating the hydrostatic imbalance when the user is substantially horizontal, so as to reduce the variations in breathing effort.

According to a third aspect of the invention there is provided a wearable breathing apparatus comprising a double counterlung having supply and return chambers connected for inflation and deflation in unison, the counterlung having a common member movable in use towards and away from a user, said common member having a substantial mass.

Attaching heavy material onto or incorporating it into the common member, typically a hinged plate, that constrains the two counterlungs reduces the hydrostatic imbalance by applying a gravitational force that acts on the common member to increase or decrease the pressure in the double counterlung according to the orientation of the member above or below the user's lungs. This reduces the effect that the orientation of the diver has on the effort required to breathe in from and out into the double counterlung.

Typically a double counterlung has a swept volume of between 4.5 and 5 liters, and in accordance with this aspect of the invention an additional mass in the range 3-10 kg is added to the common member, preferably 5-9 kg.

Preferably the common member is an upright hinged plate having a substantially horizontal hinge axis at the lower edge, and the substantial mass comprises a weight member at or close to the free edge of said plate. The weight member may be in the form of a strip or bar attachment, preferably of around 7 kg. The centre of gravity of the weight member is preferably about 200 mm perpendicularly above the hinge axis. The weight member may extend across the full width of the common member.

The relatively heavy common member keeps the pressure in the double counterlung closer to the water pressure acting on a diver's lungs, making it easier for the diver to breathe.

Preferably the double counterlung includes relief valves each having a respective movable plate-like valve element. Preferably such a valve element, typically in the form of a free disc, has a substantial mass.

Making the valve elements of double counterlung relief valves from a heavy material ensures that the relief valve opening pressure varies in the similar way that the pressure in the double counterlung is affected by the weight incorporated into the common member.

Typically such a relief valve has seat diameter of around 10 mm and a valve element having a mass in the range 14-25 gm.

The weighted valve elements on the pressure and suction relief valves means that the pressure at which they open is more closely related to the water pressure acting on the diver's lungs so avoiding any risk of damaging the diver's lungs through over or under pressurization.

The mass of the common member and/or valve elements is a straightforward calculation according to the maximum vertical distance between the effective centre of the lungs of the user (the lung centroid) and the effective centre of the hinged plate of the double counterlung.

Preferably the relief valves are mounted on the common member of the double counterlung, and have respective disc-like valve elements movable substantially perpendicularly to the plane of said common member, typically a hinged plate.

The weighted valve plates on the pressure and suction relief valves mean that the difference between the opening pressures of the relief valves and the mean pressure in the counterlungs can remain substantially constant. This enables that the opening pressures of the relief valves remain close to their optimum setting regardless of the orientation of the diver.

Preferably a double counterlung backpack is provided. In a preferred embodiment the weighted common member, and/or weighted valve elements are incorporated within a double counterlung backpack. Preferably the backpack is contoured to follow the curvature of the user's shoulders, so as to move the counterlung closer to the lungs of the diver, thereby reducing the amount of weight needed to minimize the hydrostatic imbalance. In a preferred embodiment the counterlung comprises a rigid backpack having inflatable counterlung chambers thereon, and a rigid shield over said chambers, said shield having apertures to permit the counterlung to expand and contract by displacement of water through said apertures. The shield is preferably removable for inspection of the double counterlung.

Three factors need to be addressed when designing a compressor for a diver's gas reclaim system:

1. The inlet pressure to the compressor is determined by the diver's depth and can be several times higher than the increase in pressure across the compressor. This means that the compressor casings have to be strengthened considerably and seals on the inlet side have to withstand far higher pressure differential than they would on a compressor with atmospheric inlet.
2. The breathing gas typically contains a high proportion of helium, which has a very small molecule making it difficult to seal against leaks.
3. The breathing gas is re-circulated and so any contaminants that enter the system and are not removed will build up over time, increasing their toxicity. This means that materials that might introduce vapours or gasses into the breathing circuit, such as oils and greases, have to be avoided.

Both air driven gas boosters and reciprocating compressors are currently used in breathing gas reclaim systems but in both cases considerable modifications of standard equipment is required. Reciprocating compressors are considerably quieter and more efficient than the gas boosters but required specially designed dry running seals on the connecting rods and pistons. There is considerable heat generated by the seals and the possibility of an appreciable leakage through them. Putting an electric motor and pump assembly in a pressure vessel has been tried but is very bulky and if the motor overheats the resins in the motor windings produce toxic gasses that can enter the breathing circuit.

What is required is a better compressor arrangement for the breathing circuit of a diver.

According to a fourth aspect of the invention there is provided a hybrid gas compressor for circulating breathing gas to a double counterlung, and comprising an ejector pump as first stage and a centrifugal compressor as second stage, wherein the centrifugal compressor is substantially over-sized such that excess output therefrom comprises the motive gas for said ejector pump.

Preferably the volume output of the centrifugal compressor is at least five times as great as the breathing volume requirement of a diver. In a preferred embodiment the volume output is 8-10 times greater than the breathing volume requirement.

A double counterlung for a diver considerably reduces pressure drops in the breathing circuit compared to other gas reclaim systems, and this makes an oversize centrifugal compressor a suitable option.

Advantages of the centrifugal compressor are:

Considerable reductions in size and noise as compared with a reciprocating compressor Greater pumping efficiency Ease of sealing around the relatively small rotating impeller shaft of a centrifugal compressor as compared with reciprocating piston connecting rods of a large reciprocating compressor.

Theoretically, the flows and pressures required for a diver's breathing circuit can be achieved in one stage with an 11 mm impeller but it would need to rotate at a million rpm. A two stage centrifugal compressor would half the speeds needed but these are still too high to be practical and the impellers would remain very small and so be very difficult to manufacture.

A centrifugal compressor delivering about half of the required increase in pressure and delivering around 10 times the breathing volume requirement is a practicable possibility. Said compressor would have an impeller of about 35-40 mm, run at around 200,000 rpm and can be driven through gearing by an electrical motor, i.c. engine or hydraulic motor; alternatively it could be driven directly by a gas turbine in a similar arrangement to a turbo charger of an i.c. engine.

The worst case is when the diver is at the surface because the inlet pressure is below ambient, the mass flow is low and the inlet to outlet pressure ratio is high. As the diver descends the gas density increases and the pressure ratio decreases reducing the speed at which the impeller needs to rotate to develop the required increase in pressure.

The diver's double counterlung described in WO89/01895 A1 is used in both the primary gas reclaim breathing circuit and in the secondary or backup rebreather circuit. During normal operation the gas in the double counterlung is prevented from circulating through the rebreather portion of the diver's backpack by closing off the connection between the return counterlung and the carbon dioxide scrubber of the rebreather circuit. The oxygen and diluent gas supplies of the rebreather circuit are also shut-off when the rebreather is not in use. A valve is required that is simple for the diver to operate, and that will open and close all three passage ways of the rebreather simultaneously, on demand.

Pure oxygen is a fire hazard because it increases the combustibility of other materials. This restricts the materials that can be used to contain it.

The breathing system described in WO89/01895 A1 has two backup modes in case of a failure in the gas reclaim system:

1. A rebreather mode that utilizes the counterlung that is incorporated into the primary breathing system but does not need the surface supply.
2. An open circuit demand system that uses the surface supply but bypasses the counterlung.

This means that no single failure will compromise the diver's safety. The diver decides which backup mode to activate, and this depends on the type of failure in the primary gas reclaim system.

In order for either backup mode to operate effectively a combination of gas passages need to be opened or closed in accordance with the following table.

| | | Operational mode | | |
|---|---|---|---|---|
| No | Gas passage | Gas Reclaim | Rebreather | Open Circuit |
| a | Surface supply to counterlung | Open | Closed | Closed |
| b | Surface supply to OC regulator | Optional | Optional | Open |
| c | Return to surface from counterlung | Open | Closed | Closed |
| d | Counterlung to CO2 scrubber | Closed | Open | Optional |
| e | Backpack oxygen supply | Closed | Open | Closed |
| f | Backpack diluent gas supply | Closed | Open | Closed |
| g | Counterlung to diver hoses | Open | Open | Closed |
| h | OC regulator to diver | Closed | Closed | Open |

According to a fifth aspect of the invention a double counterlung assembly comprises valves operable to select one of a gas reclaim breathing circuit, a rebreather circuit and an open circuit breathing circuit, wherein said valves are grouped into three sets of valves. Preferably one, more preferably two and most preferably all of said sets have a single respective actuator.

It will be understood that the open circuit breathing circuit is not a circuit as such, because gas is vented into the water; the gas reclaim and rebreather circuits are closed circuits.

The diver is thus able to activate the selected backup mode with the minimum number of operations, rather than open or close each valve separately.

In the preferred embodiment a first set of valves is operable to close passages a and c to isolate the counterlung from the supply and return hoses connecting it to the surface and maintain communication between the supply hose and a demand regulator via passage b. This first set is operated for backup by rebreather or open circuit.

In the preferred embodiment a second set of valves is operable to open passage d, e & f to activate the rebreather.

In the preferred embodiment a third set of valves is operable to close passages g and to open passage h, to isolate the diver from the backpack and connect the supply to the open circuit demand regulator. The third set of valves can be incorporated into a mouthpiece, full face mask or a sealed helmet.

In a preferred embodiment the first set of valves is provided on a chest mounting for a diver. Preferably the second set of valves are provided on the backpack. The third set of valves is at the mouth, preferably on the mouthpiece, mask or helmet.

To avoid accidental operation the actuators of said valves preferably include a latch which must be released to permit operation thereof. Said latch may comprise a squeeze release, and said actuators may be push-pull or pivotable. A lock may be provided to maintain said actuators in one or other operating condition.

According to a sixth aspect of the invention there is provided a three part spool valve for a double counterlung comprising a casing defining three independent flow passageways, and a spool pivotable in said casing to open and close said passageways in unison. Preferably the spool is of PTFE, and said casing is of an oxygen compatible material, for example brass. The spool is preferably cylindrical, and may have several diameters in a stepped arrangement.

In use said passages respectively control a diluent gas supply, an oxygen supply and a connection to a gas scrubber, and are separated by suitable seals, such as O-rings.

The pressure differential between the counterlung and the rebreather scrubber is very small but the passage way is relatively large. The oxygen and diluent are at a medium pressure and accordingly the passageways are relatively small. A large diameter of a stepped spool comprises a passage for the re-breather scrubber, whereas a relatively small diameter has passages for the diluent gas and oxygen. The spool diameters have a typical ratio of 3:1.

Such a spool valve is preferably incorporated within a double counterlung backpack and said spool comprises a pivotable shaft protruding from the backpack and having an external actuator, such as a lever, for operation thereof by a wearer of the backpack, whereby said spool may be pivoted between open and closed positions.

Rebreather systems for a diver use chemical granules known as soda-lime to react with the carbon dioxide in expired air from the diver, and remove it from the system through a chain of reactions with the various chemicals in the granules. The soda-lime is contained in a scrubber that channels the expired gas through the soda-lime granules. The efficiency of the soda-lime, i.e. the amount of $CO^2$ that is removed by a given quantity of soda-lime, is dependent on;

The temperature of the soda-lime

The moisture in the soda-lime

The surface area and hence granule size (smaller is better)

The time that the expired gas is in the soda-lime

The even distribution of the flow of expired gas through the soda-lime as it passes through the scrubber The even compaction and distribution of the soda-lime in the scrubber A significant proportion of the work that the lungs of the diver expend circulating gas around the rebreather is due to the pressure drop in the scrubber, which is dependent on;

The cross-sectional area and depth of the scrubber,

The soda-lime granule size (smaller is worse)

The filter material that holds the soda-lime in place whilst allowing the expired gas to pass through it.

Some dust is generated by the movement of the soda-lime granules and the filter material that constrains the soda-lime needs to capture a significant proportion of this dust so that it does not get into the lungs of a diver. For most rebreather systems, expired gas is only moved through the scrubber during exhalation. It then remains static in the scrubber during inhalation which gives the carbon dioxide in the expired gas more time to react with the soda-lime.

In the diver's breathing system described in WO89/01895 A1 the configuration of the double counterlung causes half the expired gas to be moved through the scrubber during exhalation and half during inhalation. Whilst this does not affect the total time that the expired gas spends in the scrubber the way that it moves through the soda-lime is changed, as compared with other prior art.

According to a seventh aspect of the invention there is provided a carbon dioxide scrubber for breathing gas of a double counterlung and comprising concentric tubes containing soda-lime, an inlet being provided at one of said concentric tubes, and said tubes being porous to permit gas to pass through the tubes, but to prevent particles of soda-lime from passing the tubes. The tubes are structural and a filter material.

The scrubber is in use mounted within an enclosure so that gas passing through the outer tube enters the supply side of the rebreather breathing circuit.

Preferably the tubes are of sintered metal or plastic, and are circular. The tubes are preferably closed by one or more removable end plates, and said end plates are adapted to apply a compressive load upon soda-lime granules contained within the tubes, for example by pressure from a spring.

Oxygen needs to be added to a rebreather as it is used up by the diver. Add too much and the oxygen becomes toxic, add too little and the diver is starved of oxygen. The partial pressure of oxygen needs to remain between 0.2 bar absolute and 1.6 bar absolute. Partial pressure is a measure of the concentration of a gas and is the product of the percentage of a gas in a mixture and the absolute pressure of the mixture. As the diver descends and the pressure increases, the percentage of oxygen required to maintain a safe partial pressure decreases. The rate at which the diver uses up oxygen is dependent on how hard they are working and is closely aligned with the rate at which they are breathing (around 4% of the rate of breathing). The relationship between oxygen usage and rate of breathing not only varies from diver to diver but also during a dive as work rate changes.

Fully closed circuit rebreathers tend to use electrical oxygen sensors and electronic controls to main the partial pressure within predetermined limits. There is however always the risk that water will get into the electronics, particularly at depths at which water pressure puts considerable strain on the housing and seals.

Semi-closed circuit rebreathers tend to add oxygen rich gas mixtures mechanically. The amount added is sufficient to provide the expected oxygen usage. This means that more gas is added to the breathing circuit than is used by the diver so a small amount of gas has to be vented from rebreather whenever a counterlung becomes full. As the gas in the breathing circuit has a lower proportion of oxygen in it than the oxygen rich gas mix that is being added to the circuit, this means that there is some oxygen in the gas vented from the rebreathing circuit. If the amount of oxygen being added is more than what the diver is using and the oxygen being vented, the proportion of oxygen in the breathing circuit increases and so the amount of oxygen in the vented gas also increases until a balance is achieved. If less oxygen is being added than is being used by the diver and being vented from the breathing circuit the proportion of oxygen reduces, and so the amount of oxygen vented from the circuit also reduces until a balance is achieved. The vented gas therefore stabilizes the oxygen content to some extent by releasing more oxygen when the diver is using up less oxygen than the projected and releasing less oxygen when the diver is using more oxygen than projected. The more gas vented the more of a stabilizing effect that the vented gas has but the more gas is used over a given period.

There are various methods of adding the gas to the breathing circuit, the main ones relying upon constant mass flow or constant volume flow. Volume added is a proportion of the volume breathed and mass added is a proportion of the mass breathed. The bigger the depth range the harder it is to get the gas composition right.

According to an eighth aspect of the invention there is provided a rebreather device for a breathing circuit of a diver, and comprising two independent systems for adding oxygen thereto, the first system being adapted to add an oxygen rich gas mix as a proportion of the breathing rate of a diver, and the second system being adapted to add oxygen at a pre-determined diving depth, and to provide an increasing flow of oxygen as the diver ascends from said depth.

The hinged plate in the double counterlung of WO89/01895 A1 moves in and out as the diver breaths. Preferably this movement is used to drive a small bellows metering pump that adds oxygen rich gas to the breathing circuit at a proportion of the rate that the diver is breathing when the double counterlung is being used as part of a rebreather. A demand regulator provides gas to the metering pump at the diver's ambient pressure. Because the volume is constant the mass of oxygen added increases with depth. The demand regulator also adds gas to the breathing circuit if the double counterlung is empty.

At shallower depths additional oxygen is added at a constant absolute pressure through a flow restrictor. As the diver goes deeper the ambient pressure increases and so the pressure differential across the flow restrictor gets less and the flow of oxygen into the breathing circuit is reduced until the pressure at which the oxygen is supplied is equal to or less than the diver's ambient pressure and the flow of oxygen stops.

The bellows metering device provides a simple and reliable method of adding oxygen at the divers operating depth with a relatively high rate of gas conservation, and without the need to rely on electronic control systems.

Losses from leaks are automatically made up by providing a demand regulator in the breathing circuit.

The supplementary method of adding oxygen at the shallower depths substantially eliminates any risk of the diver becoming hypoxic during surfacing and decompression.

An open-circuit supplied compressed gas diving apparatus with a demand regulator has to have an umbilical supply hose that is big enough to supply the peak flow of about 240 l/min demanded by a diver breathing at 75 l/min. This hose could be considerably smaller if the flow through the hose could be spread out over the breathing cycle. This in turn would reduce the size of the umbilical that the diver has to take with them. If the supply hose is sized to carry about 120 l/min at a constant rate, as is the case with the breathing system described in WO89/01895 A1, there would be insufficient gas supplied during inhalation to enable an open circuit demand regulator to operate correctly.

According to a ninth aspect of the invention there is provided a double counterlung backpack for a diver and including an accumulator to supplement the flow of gas to the open circuit demand regulator of the diver during periods of peak inhalation. During exhalation the accumulator is re-charged from the supply duct. Peak flow in the supply umbilical is thereby reduced, so that the size of the umbilical can also be reduced. Such an arrangement is useful when the diver is on open circuit regulator connected to a supply umbilical, with the counterlung isolated, and the return umbilical closed.

Other features of the invention will be apparent from the following description of preferred embodiments illustrated by way of example only in the accompanying drawings in which:—

FIG. 6 illustrates a contoured backpack incorporating a double counterlung.

FIG. 7 is a schematic illustration of a primary breathing circuit.

Figure 13A:
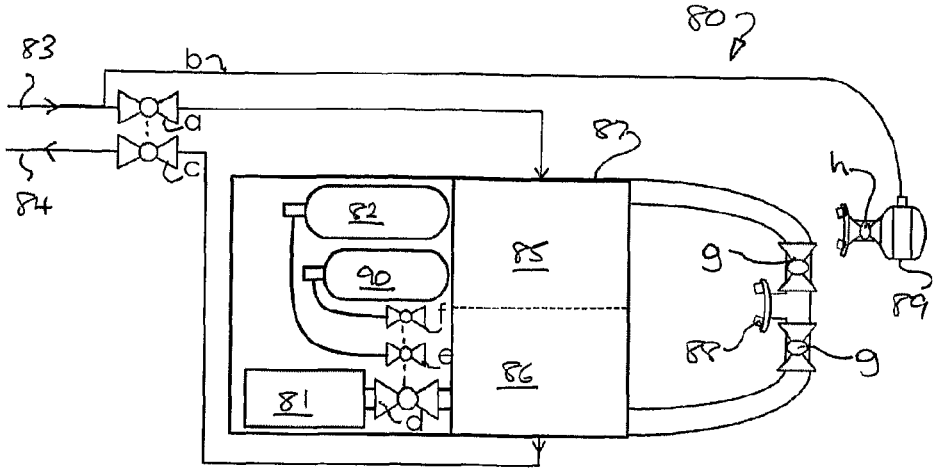

FIG. 13*a* illustrates a divers breathing circuit with the shut off valves

Figure 13B:
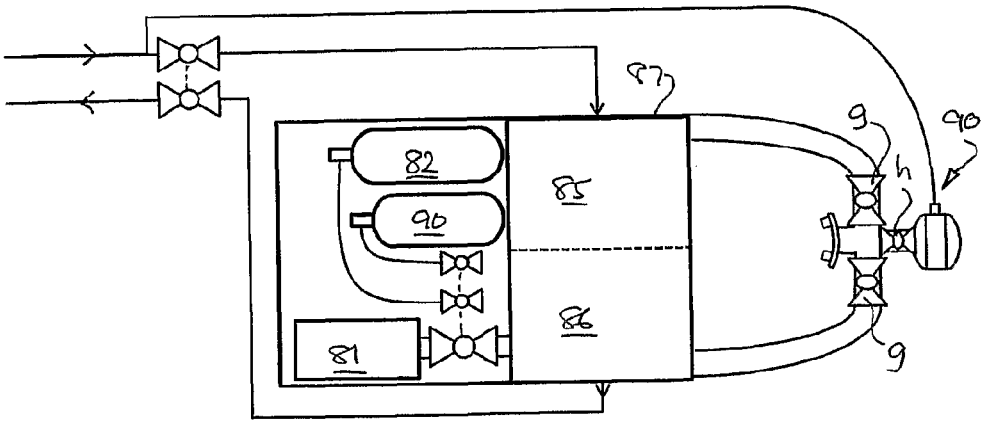

FIG. 13*b* illustrates a divers breathing circuit with one mouthpiece

Figure 13C:
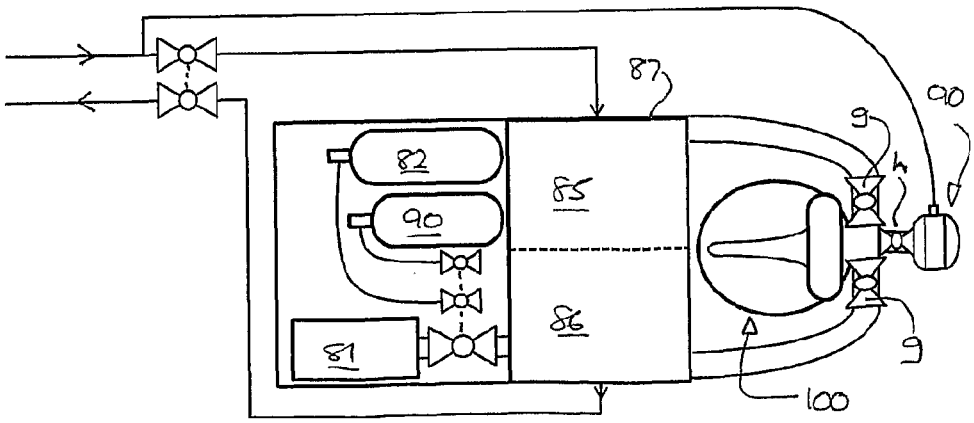

FIG. 13*c* illustrates a divers with a helmet

Figure 14:
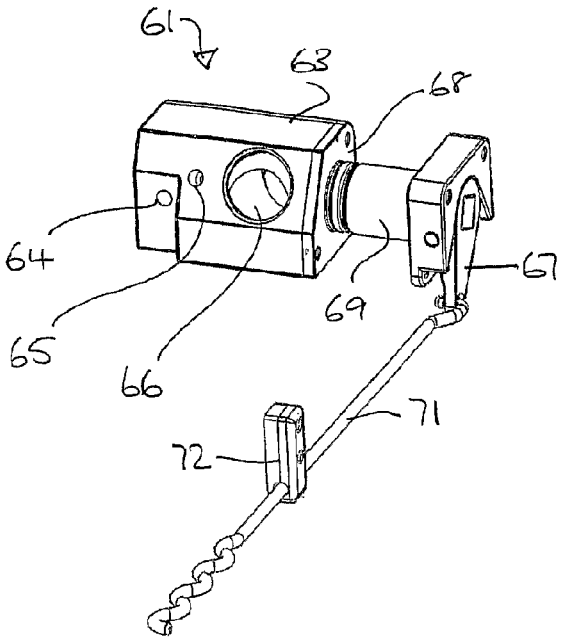

FIG. 14 shows a spool valve assembly for activating a rebreathing circuit.

Figure 15:
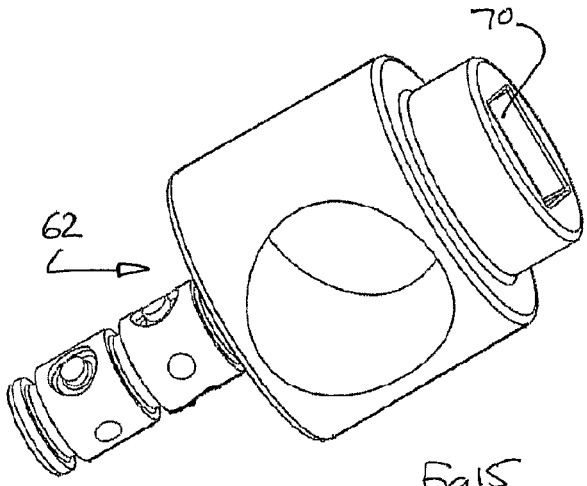

FIG. 15 shows a valve spool for the valve of FIG. 14.

Figure 16:
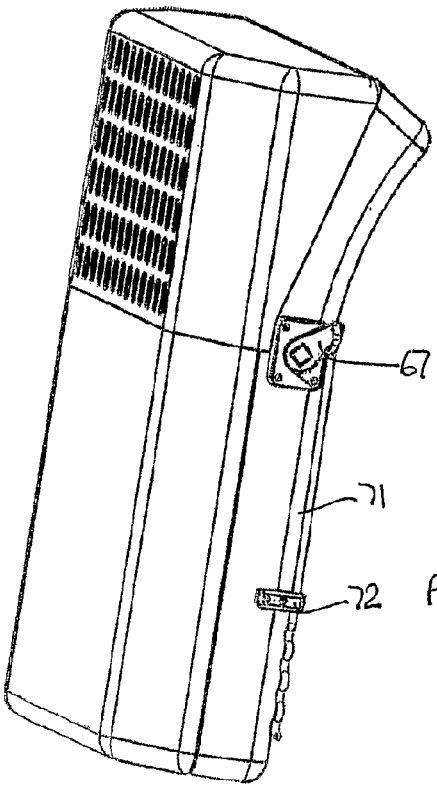

FIG. 16 shows a divers backpack incorporating the valve of FIG. 14.

Figure 17:
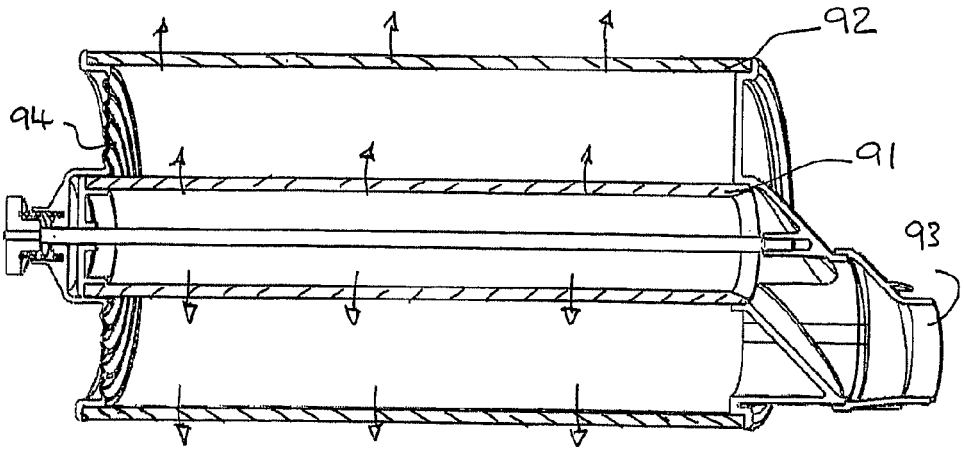

FIG. 17 illustrates in axial section a carbon dioxide scrubber.

Figure 18:
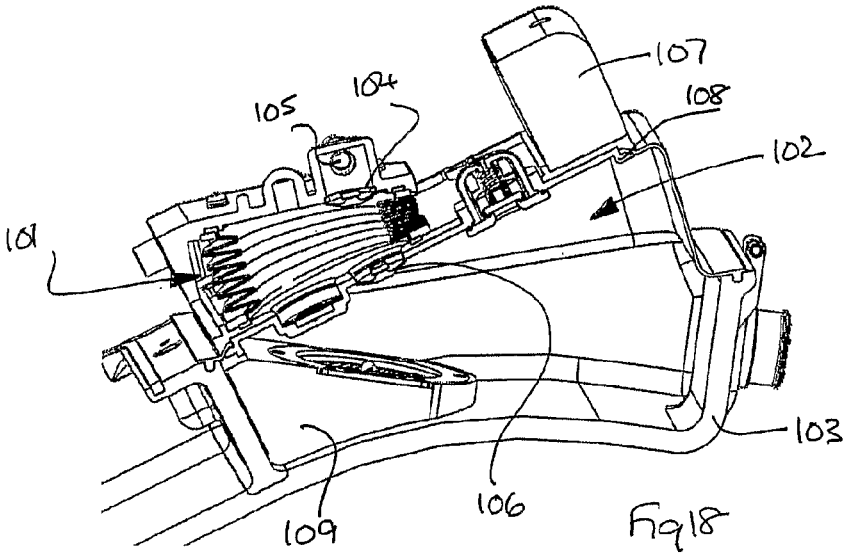
Figure 19:
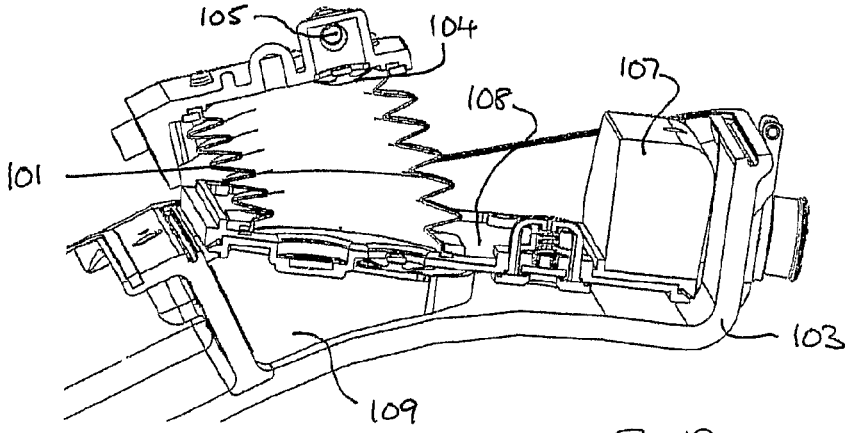

FIGS. 18 and 19 show in axial cross-section an oxygen metering assembly for a double counterlung.

FIG. 20 shows in axial cross-section a valve and flow restrictor for adding oxygen to a breathing circuit.

FIG. 21 shows in axial section an accumulator for a divers backpack; and

FIG. 22 shows a breathing circuit incorporating the accumulator of FIG. 21.

In this specification, the term upright refers to the orientation with respect to a standing user wearing a double counterlung backpack. Other references to orientation should be interpreted accordingly.

Figure 1:
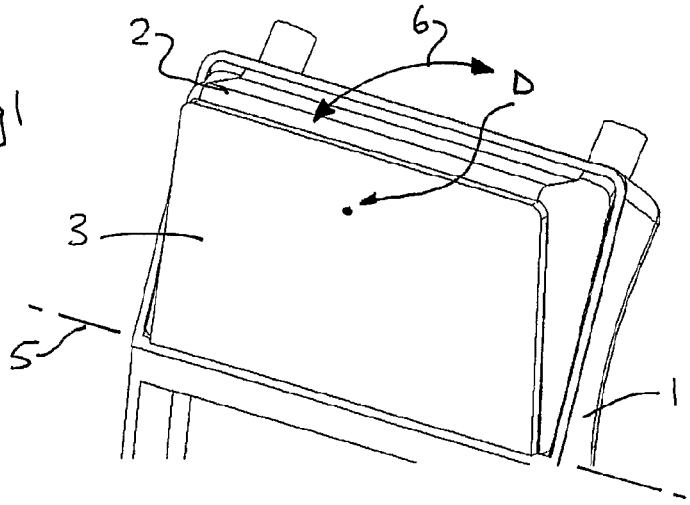
FIG. 1 is a schematic illustration of the bellows part of a counterlung backpack, from the rear.
Figure 2:
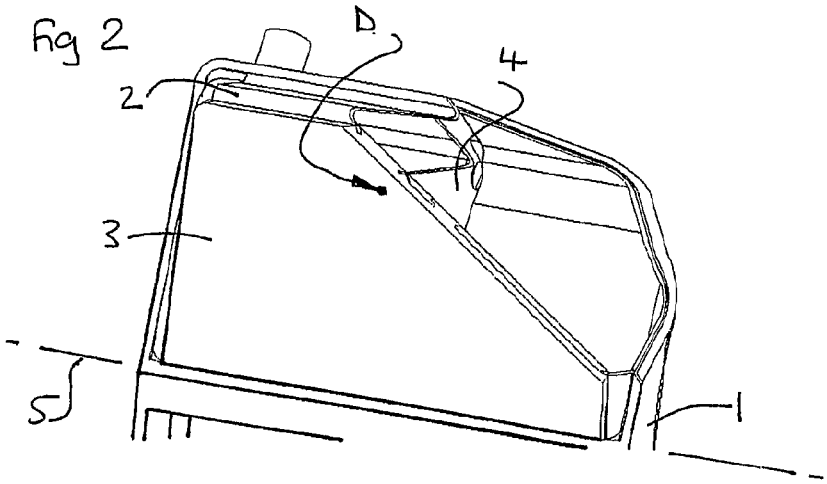
FIG. 2 is a cut-away version of FIG. 1.
Figure 3:
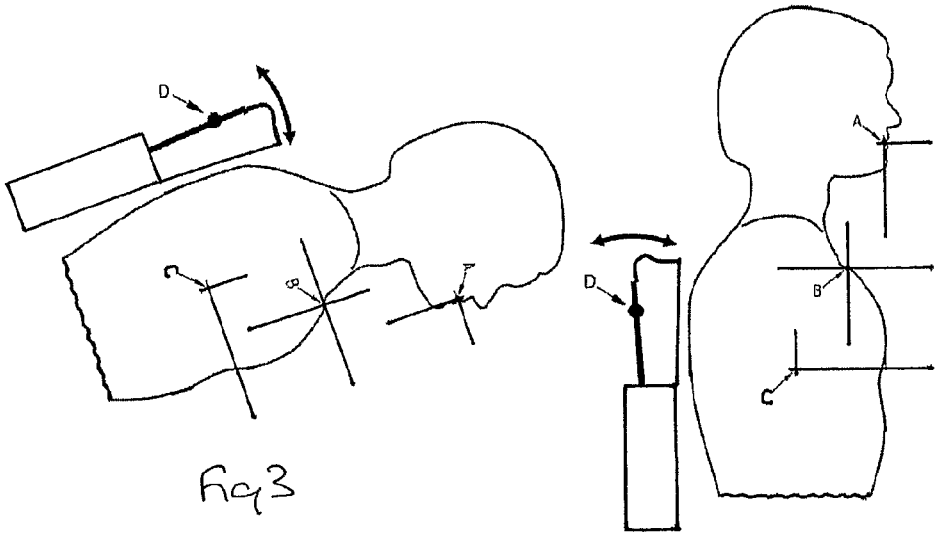
FIG. 3 illustrates schematically a potential hydrostatic imbalance.

With reference to FIGS. 1-3 a backpack double counterlung for a diver comprises a body 1, an outer membrane 2, an upright hinged plate 3 and an inner-membrane 4 that separates the supply counterlung from the return counterlung. The substantially horizontal hinge axis 5 allows the side by side counterlungs to act like a bellows as they inflate and deflate as illustrated by arrow 6. The mouth of the diver is indicated at A, the suprasternal notch at B, and the lung centroid at C.

By resolving the forces acting on the counterlung in the water it can be shown that the average pressure in the two counterlungs will be the same as the water pressure at a point about two thirds of the distance from the hinge to the opposite edge of the plate and equidistant from the other two edges as indicated by point D. This is the effective centre of the counterlung.

Either attaching a weight to the hinged plate or making the hinged plate out of a heavy material makes the gravitational force acting on the hinged plate significant. When the diver is prone the gravitational force pushes down on the hinged plate. To balance out this force the pressure in the two counterlungs increases. If the right amount of weight is added to the hinged plate the pressure in the counterlungs becomes the same as the pressure of water acting on the lungs. The leverage provided by the hinge means that the amount of weight needed for the pressure in the counterlung to match the pressure acting on the diver's lungs is reduced as the centre of gravity of the weight gets further from the hinge.

When the diver is upright the gravitational force of the weight tends to work straight through the hinge and so has little effect on the pressure in the two counterlungs. When the diver is on his back the gravitational force on the weight pulls the counterlung open reducing the pressure in the counterlungs so that it more closely matches the water pressure acting on the lungs.

The overall effect that the weight has is to move the effective centre of the double counterlung towards the middle of the lungs of the diver, thus making breathing easier when the diver is horizontal. A typical added weight is around 7 kg.

The counterlung of the invention incorporates pressure and suction relief valves 11,12 on the supply and return sides. (FIG. 4), and mounted on the hinged plate 3.

Figure 4:
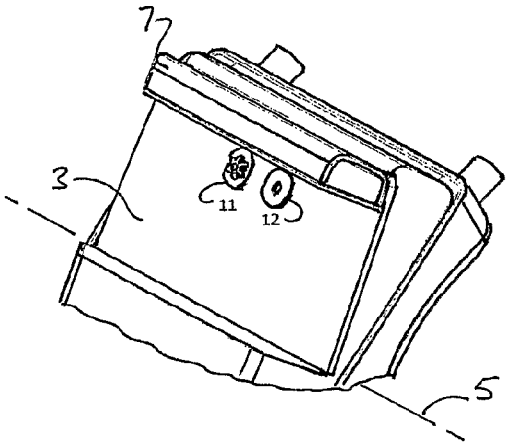
FIG. 4 illustrates the position of typical relief valves and counterbalance.
Figure 5:
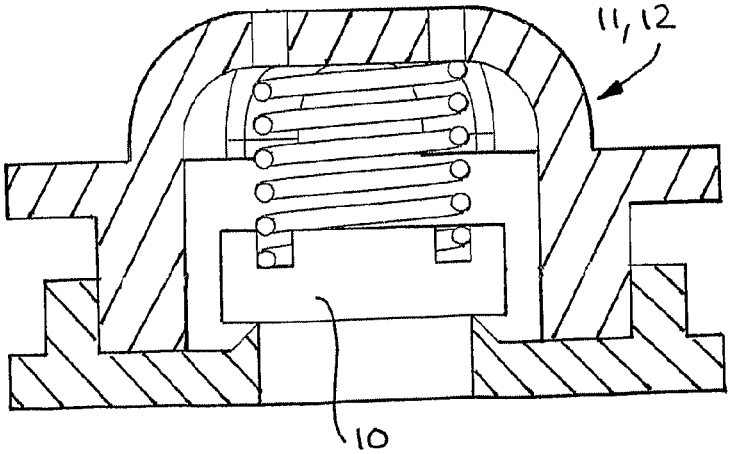
FIG. 5 shows a relief valve in axial section.

The valve plates 10 (FIG. 5) of the pressure and suction relief valves are made out of a dense material such as lead or a tungsten alloy so that the gravitational force acting on the valve plate is coupled within the force from the spring. The net effect is dependent on the orientation of the valve. When gravity and the spring work together the pressure or suction required to open the relief valve increases. When gravity and the spring work against each other the pressure or suction that is required to open the relief valve decreases. When gravity acts at a tangent to the spring the opening pressure is determined purely by the spring. The substantial weight of the valve plate typically 14-25 gm determines the extent that the relief valve opening pressure is affected by the orientation of the valve. The valves are mounted so that they face the lung centroid C with the valve plates weighted so that the opening pressure is related to the water pressure acting on the middle of the lungs. FIG. 4 shows a rectangular weight 7 at the edge of the counterlung which is opposite to the hinge axis 5.

Typically the pressure relief valve 11 (FIG. 5) will be mounted in the double counterlung plate so that it will vent excess pressure from the supply counterlung close to the effective centre D of the double counterlung. Similarly the suction relief valve 12 will be mounted in the double counterlung plate close to the effective centre D so that it opens if the pressure in the return counterlung drops too low.

The double counterlung of the invention is preferably incorporated into a backpack 13 (FIG. 6) that is shaped at the top so that it follows the contour of the back of the diver. This moves the counterlung closer to the lungs of the diver as illustrated, and reduces the amount of weight needed on the hinged plate and in the relief valves to achieve the same reduction in breathing effort.

Figure 9:
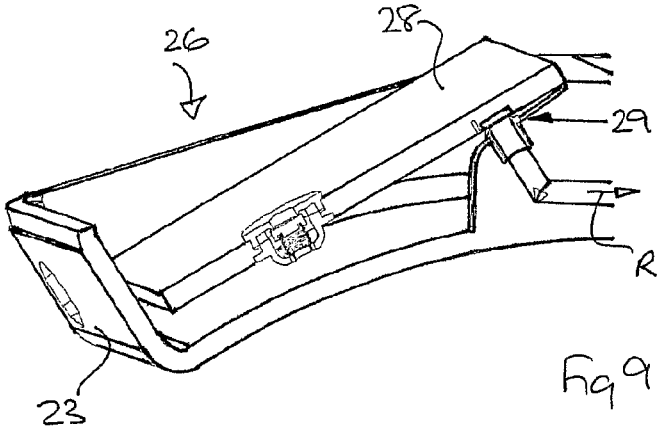
FIG. 9 illustrates the return shut-off valve of a double counterlung.
Figure 8:
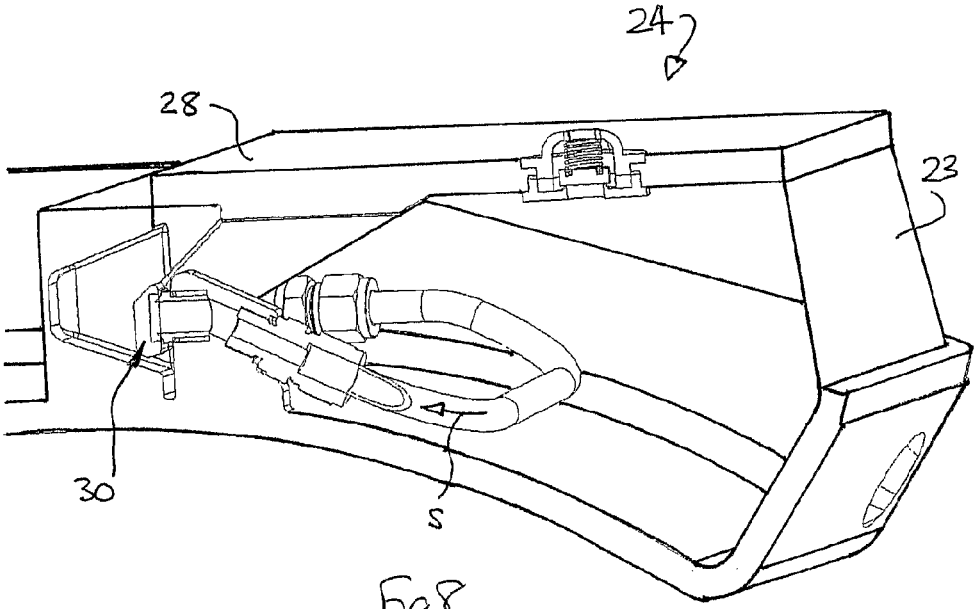
FIG. 8 illustrates the supply shut-off valve of a double counterlung.

With reference to FIGS. 7-9, during normal operation gas is pumped around the breathing circuit by the compressor 21 through the supply hose of the umbilical 22 to a backpack 23 where it travels through the supply counterlung 24 to the diver 25. The gas returns from the diver through the return counterlung 26 and back up to the surface through the return hose of the diver's umbilical. At the surface the gas is reprocessed, by a scrubber 27 for carbon dioxide removal, before being pumped back down to the diver. Also shown are oxygen supply tank 31, for oxygen make-up via make-up valve 32; a vent valve 33, a cooler 34, a water trap 35 a diluent supply tank 36 and a top-up regulator 37. The flow through the surface equipment and the umbilical is only regulated by the pressure developed by the compressor and the corresponding pressure drop in the diver's umbilical. The double counterlung 24, 26 accommodates the changes in flow required as the diver breaths in and out. The hinged plate 28 on the double counterlung constrains the two parts of the counterlung so that they fill and empty together.

When the supply side counterlung 24 is full the hinged plate 28 closes against a supply valve seat 30 that stops the supply gas from the surface as indicated by arrows. This only happens when an excess of gas in the breathing circuit causes the double counterlung fill at the end of the diver's exhalation.

When the double counterlung is empty the hinged plate 28 closes against a return valve seat 29 in the return counterlung, thus stopping gas from returning to the surface and indicated by arrow R. This only happens when there is not enough gas in the breathing circuit to prevent the double counterlung from emptying at the end of the diver's inhalation.

An arrangement that detects when the flow to or from the diver has stopped can be utilized to add or vent gas from the breathing circuit. In the present invention the main indicator that the flow has stopped is the rapid change in flow and pressure that is caused in the umbilical by closure of the valves 29, 30. The hinged plate acts as a very large diaphragm with a high mechanical advantage on the valve. This means that a small change in pressure (typically 0.0025 bar) in the double counterlung can overcome a far larger pressure (typically 10 bar) in the supply or return umbilical hoses.

When either the supply from the surface or the return to the surface is shut off the pressure in the hoses changes rapidly. A regulator valve and vent valve at the surface are activated by the rate of change in pressure in the breathing circuit, and in consequence gas can be added or vented from the circuit. This arrangement is not dependent on the diver's depth and will automatically adjust as the diver descends or ascends.

Figure 10:
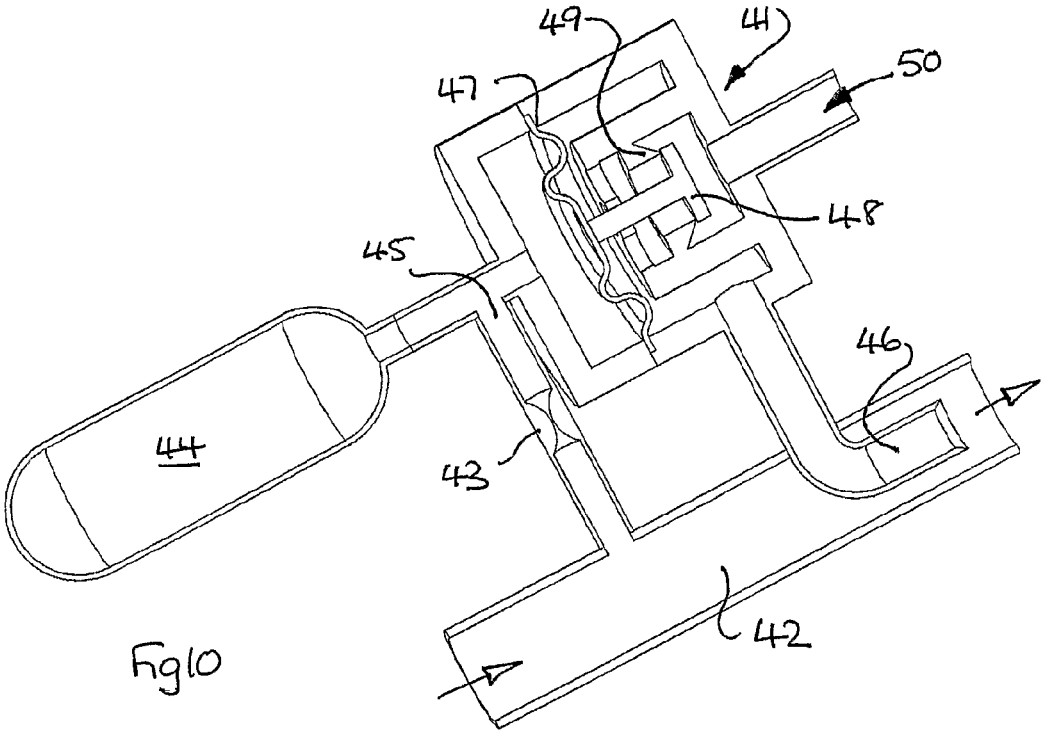
FIG. 10 illustrates addition of gas to a breathing circuit.

FIG. 10 shows an arrangement that will add gas when the pressure drops rapidly but not react to the slow reductions in pressure as the diver ascends. A dome loaded pressure regulator 41 is set to open if the pressure in the return side of the breathing circuit 42 drops below the pilot pressure so that it adds gas to the circuit. The pilot pressure is taken from the breathing circuit just upstream of the main connection to the regulator so that in normal operation the pilot and sensing pressures are the same. A flow restrictor 43 and a damping volume 44 are fitted in the pilot line 45 between the breathing circuit 42 and the regulator 41 so that when the pressure in the breathing circuit drops rapidly it takes some time before the pilot pressure equalizes with the pressure in the breathing circuit.

A diaphragm 47 divides a chamber, and is subjected to pilot pressure on one side, and pressure in the breathing circuit at the opposite side. Movement of the diaphragm 47 in response to a reducing pressure in the breathing circuit causes a valve plate 48 to lift from a valve seat 49, and to permit gas under pressure to enter the breathing circuit via duct 50.

The dome loaded regulator thus will add gas to the breathing circuit for the period that the pilot pressure is greater than the reduced pressure in the breathing circuit. This will either be until the pilot pressure has dropped to the pressure in the breathing circuit or the breathing circuit pressure has increased because the shut-off valve in the return counterlung has opened because the diver is now exhaling. The length of time that it takes for the pilot pressure to equalize is dependent on the flow coefficient of the flow restrictor and the size of the damping volume in the pilot pressure line, and may be designed empirically to suit the intended use.

If insufficient gas is added the first time that the double counterlung empties the cycle will be repeated at the end of the next inhalation. The amount of gas added each cycle can be increased by adding the gas to the breathing circuit through a venturi 46 that draws gas from the pressure regulator and therefore keeps it open for longer. The sensitivity of the venturi can be tuned to prevent the regulator staying open permanently.

Figure 11:
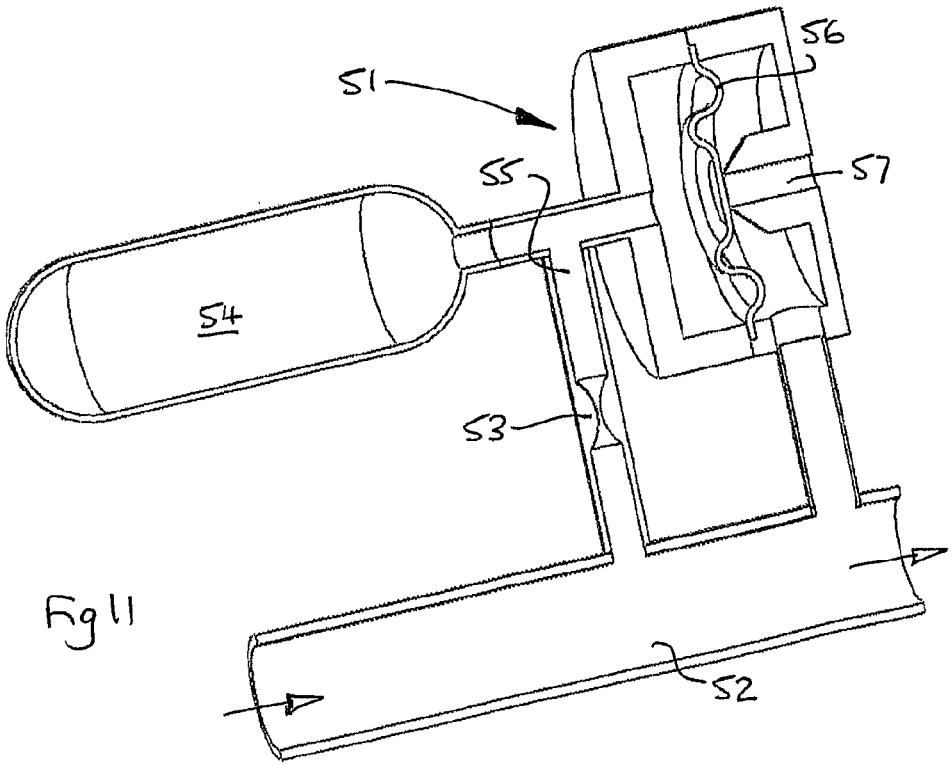
FIG. 11 illustrates venting of gas from a breathing circuit.

FIG. 11 shows an arrangement that will vent gas when the pressure increases rapidly but not react to slow changes in pressure. A dome loaded vent valve (sometimes known as a back pressure regulator) 51 is set to open if the pressure in the supply side of the breathing circuit 52 drops below the pilot pressure so that it vents gas from the circuit. The pilot pressure is taken from just upstream of the main connection of the vent valve, so that in normal operation the pilot and sensing pressure are the same. A flow restrictor 53 and a damping volume 54 are fitted in the pilot line 55 between the breathing circuit 52 and the vent valve 51 so that when the pressure in the breathing circuit rises rapidly it takes some time before the pilot pressure equalizes with the pressure in the breathing circuit. A diaphragm 56 divides a chamber, and is responsive to differential pressure to lift from the seat 58 of a vent port 57 when pilot pressure is less than the instant pressure in the breathing circuit 52.

The dome loaded vent valve will thus vent gas from the breathing circuit for the period that the pilot pressure is lower than the increased pressure in the breathing circuit. This will either be until the pilot pressure has risen to the pressure in the breathing circuit or the breathing circuit pressure has reduced because the shut off valve in the supply counterlung has opened because the diver is now inhaling. The length of time that it takes for the pilot pressure to equalize is dependent on the flow coefficient of the flow restrictor and the size of the damping volume in the pilot pressure line, and can be determined empirically.

If insufficient gas is vented the first time that the double counterlung fills the cycle will be repeated at the end of the next exhalation.

Figure 12:
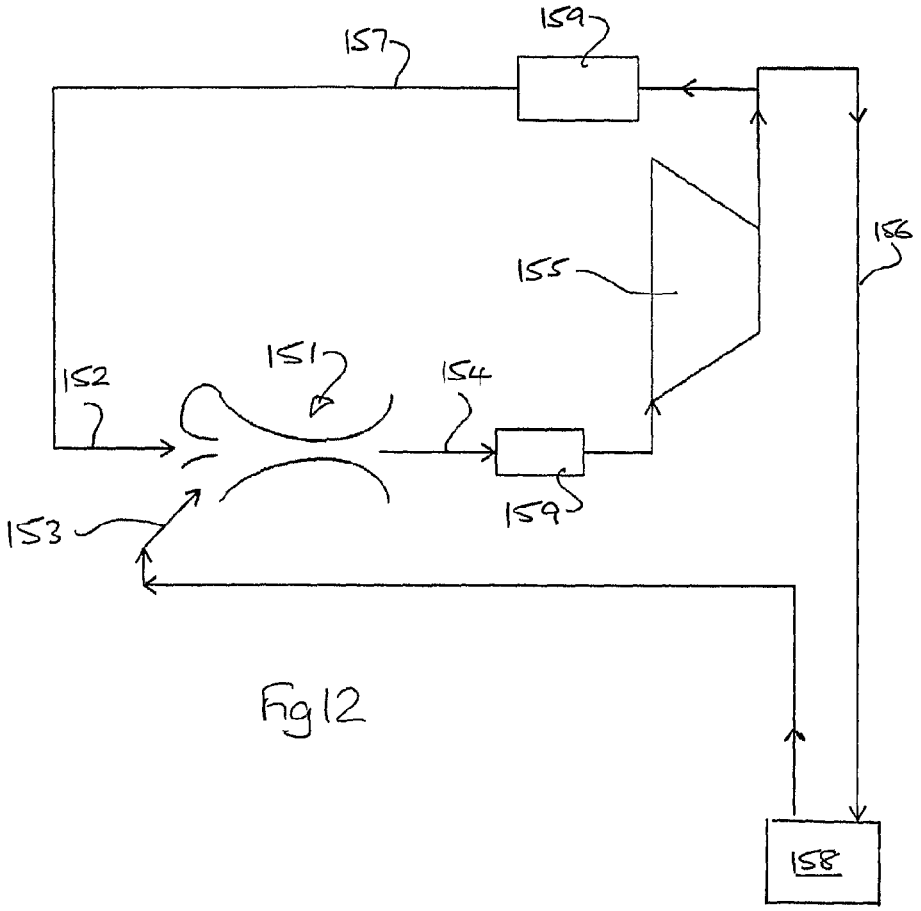
FIG. 12 illustrates a two-stage compression for a breathing circuit.

FIG. 12 shows the arrangement of first and second stage compressors.

The first stage jet/ejector compressor 151 uses the momentum from the motive gas 152 to draw in the suction flow 153 as the two gas streams mix. The mass of gas discharged 154 is the sum of the mass of motive gas and the mass of suction gas. The gas is discharged at a higher pressure than the suction pressure and a lower pressure than the motive gas.

In this case the term suction is relative because, whilst the suction pressure is below the ambient pressure acting on the diver, it may be considerably more than atmospheric pressure.

The second stage centrifugal compressor 155 is sized to pump both the gas returned from the diver and the motive gas that is mixed with it by the first stage. After the second stage the flow of gas is split so that a required amount of gas is pumped via supply line 156 to the diver 158 and the remainder 157 is used as the motive gas for the first stage ejector compressor creating a second recirculating loop at the surface.

Typically the breathing volume requirement of a diver is 120 liters per minute whereas the output from the centrifugal compressor is 1200 liters per minute. Thus 90% of compressor output comprises motive gas for the ejector pump, which entrains the divers exhaled volume of about 120 liters per minute.

The volume of motive gas used to power the ejector compressor is considerably more than the volume of gas being circulated to the diver. The energy put into the additional gas compressed in the second stage is used to power the first stage.

Heat exchangers 159 cool the gas after the ejector 151 and compressor 155 to keep the temperature at manageable levels. In an alternative embodiment, the heat exchanger 159 after the compressor 155 is omitted, but a heat exchanger is included in the supply line 156 to cool the gas being pumped to the diver 158. This arrangement takes advantage of the condition that the jet pump 151 is more efficient with hot gas, but the compressor 155 is more efficient with cooled gas.

Air bearings or other non lubricated bearings support the impeller shaft as it turns. A labyrinth seal or other dry seal is used to minimize the amount of breathing gas that escapes between the impeller shaft and the impeller housing.

A variety of high speed power sources can be used to drive the impeller of the centrifugal compressor including gas turbine, hydraulic turbine, is motor and electric motor. Depending on the power supply a gear box may be needed to achieve the final driving speed.

The pressure rise and the gas flow to the diver are controlled by varying the speed at which the impeller of the second stage is driven, and the volume of gas that is split off to power the ejector pump 51.

Advantages of this aspect of the invention are:

- The first stage compressor has no moving parts, is robust and highly reliable.
- The second stage compressor has one moving part (the rotor) and is inherently reliable.
- The impeller in the second stage compressor is of a size that can be readily manufactured and it turns at safe speeds that are readily achievable.
- The only leak path is around the relatively small rotating crankshaft of the centrifugal compressor.
- Air bearings have low friction levels and do not introduce contaminants into the breathing circuit.
- The size and noise levels are less than a reciprocating compressor.
- The efficiency is higher than a reciprocating compressor.
- The simple design is easy to control and maintain and has a high reliability.
- Because most of the gas is circulated through the ejector pump the centrifugal compressor will not stall if the diver's breathing circuit is temporarily shut or blocked.

FIG. 13*a* illustrates part of a double counterlung breathing circuit 80 for a diver with the arrangement of the various shut-off valves needed to activate either of two backup breathing circuits.

Shut-off valves a, c are connected so that they are opened and closed together by one movement. They are situated in the primary breathing circuit between the supply and return hoses 83, 84, which are typically in an umbilical of the diver, and the supply and return counterlungs 85, 86 in a backpack 87. The loop in the gas reclaim circuit is completed by the pair of hoses and mouthpiece 88 that connects the diver to the counterlungs.

The connection between supply hose 83 and the hose b to the open circuit demand regulator 89 is situated upstream of the supply shut-off valve a so that the connection between the surface and the demand regulator is maintained in all positions of valve a.

Shut off valves d, e and f are also connected for operation in unison so that the passage between the return counterlung and the carbon dioxide scrubber 81 in the diver's backpack, the oxygen supply 82, and the diluent gas supply 90 are all opened and closed together. The backup rebreather circuit is activated when these valves are opened but in order ensure that it will operate effectively valves a and c also need to be closed.

The shut off valves g and h are connected for operation in unison so that when the valves g are open the valve h is closed and vice-versa. The backup open circuit regulator is activated when the valves g are closed and valve h is open but in order to ensure that it will operate effectively valves a and c also need to be closed.

FIG. 13*b* shows the mouthpiece and the open circuit demand regulator combined into one assembly 90 so that the diver does not have to swap mouthpieces in the water. FIG.

13*c* shows this assembly incorporated into a diving helmet 100. It could also be incorporated into a full face mask.

The gas reclaim shut-off valves a and c are preferably mounted on the chest of the diver for easy access. They could however be mounted in the backpack, provided that easy access to the mechanism is maintained. Depending on the valve arrangement, the valves are preferably shut either by pushing a plunger or turning a handle clockwise. To prevent accidental operation a squeeze release latch stops either the plunger or handle from moving until it is squeezed. The valves can be opened by either pulling the plunger or turning the handle anticlockwise, depending on the type of actuator fitted. Other kinds of actuator are possible.

Both gas reclaim valves a, c must be closed in order to ensure that the back-up systems can operate effectively in all scenarios. The arrangement means that simple actions by the diver will shut down the primary gas reclaim system and allow the rebreather and the open circuit demand backup systems to operate effectively, depending on the back-up system selected by the driver.

The action is reversible so diver can test the backup systems.

FIGS. 14-16 illustrate schematically a three-part spool shut-off valve 61 having a spool 62 made of PTFE and the casing 63 made of oxygen compatible material such as brass. The spool is arranged to open and shut all three ports 64-66 at once. The valve is connected to a lever 67 outside the backpack by a bulkhead connection. 'O' ring seals are incorporated into the spool of the oxygen and diluent portion of the shut off valve. A flow restrictor in the oxygen controls the flow of oxygen into the breathing circuit when the valve is open.

The spool 62 has three passage ways through it. These are arranged so that when the valve is open all three passageways align with the ports in the body and when the valve is closed the ports are blocked. The largest passage 66 connects the return counterlung to the carbon dioxide scrubber. A second passage 65 is for the diluent gas and the third passage 64 is for the oxygen. The spool is held in the body by an end plate 68. The spool is turned by a shaft 69 that runs through a bulkhead connector and fits into a square socket 70 in the spool. A lever 67 attaches to the shaft where it penetrates through the backpack casing. A pull push rod 71 constrained by a guide 72 is used to pivot the lever. The bulkhead connector in the backpack casing restricts the lever so that it can only turn through 90°. 'O' ring seals stop leaks through the bulkhead connector. Wiper rings stop dirt getting between the shaft and the bulkhead connector and damaging the bearing faces and the moving seals.

The simple operation of pulling the lever will open the valve, and pushing the lever will close the valve. The lever is preferably biased to one or other end portion to ensure that the rebreather circuit is fully closed or fully open.

The operation of the backup rebreather can be checked at any time before or during a dive and then turned off again.

PTFE is both oxygen compatible and a dry lubricant.

Oxygen is added to the rebreather upstream of the carbon dioxide scrubber so that it will be well mixed with the breathing gas by the time it reaches the diver.

FIG. 16 illustrates the external appearance of a double counterlung backpack, showing the lever 67 pull/push rod 71, and guide bracket 72. The operating rod 71 is preferably upright on the backpack and adjacent the user at one side. This location ensures that accidental operation thereof can be avoided.

FIG. 17 shows a concentric carbon dioxide scrubber comprising inner and outer cylinders 91, 92 of sintered plastic. Pellets of soda-lime are contained within the cylinders and allow the expired gas from the diver to pass from an inlet 93 in through the inner tube 91. Gas then passes through the pellets and then through the outer cylinder 92 into the backpack (not shown). The sintered plastic is designed to retain the pellets and capture any dust that they generate whilst providing negligible resistance to the expired gas passing the walls of the cylinders. Arrows show the flow direction of breathing gas. Other kinds of filter material may be used for the walls of the cylinders provided that the contamination of the breathing circuit by soda-lime dust is avoided.

The radial flow and length of the scrubber provide a large cross sectional area and a short distance for the gas to flow through, significantly reducing the breathing resistance whilst ensuring an even flow of expired gas through the scrubber. The design also retains the heat from the chemical reaction further improving the efficiency of the soda-lime. A removable end plate 94 allows the used pellets to be replaced. It is spring loaded and designed to keep the pellets lightly compressed so that they do not form voids or rub against each other producing dust. The illustrated design has the expired air flowing in through the smaller cylinder and then out through the larger cylinder but the flow could be reversed in an alternative design. The volume of soda-lime held in the illustrated counterlung is about 1.5 liters, which is sufficient when used with the double counterlung described WO89/01895 A1 as the maximum volume of a pulse of expired gas through the system is 1.5 liters or half the 3 liters tidal volume when a diver is working at a rate of 75 liters per minute. For conventional rebreathers the volume of soda-lime in the scrubber would need to be increased to over 2 liters which is the tidal volume that is used when testing the endurance of a carbon dioxide scrubber.

FIGS. 18 and 19 illustrate apparatus for adding oxygen to a breathing circuit of a driver. FIG. 18 comprises a metering bellows pump for use with a double counterlung. FIG. 20 shows a valve and flow restrictor to regulate an amount of oxygen added to the breathing circuit.

With reference to FIG. 18, a metering bellows 101 that has about 3% of the displacement of the counterlungs is mounted on the external face of the hinged plate 108 that constrains the supply and return counterlungs 102 so that as the counterlungs inflate the bellows is compressed. A rigid counterlung backpack 103 provides a reaction member for the bellows 101. The gas in the bellows is forced through a mushroom (one-way) valve 106 into the supply counterlung. As the counterlungs deflate, gas is drawn into the metering bellows through a non return valve 104 that is connected to the inlet 105 which is supplied with an oxygen rich gas mix from a demand regulator 109 that maintains the supply pressure at just below the pressure in the double counterlung. The demand regulator is in turn supplied from a high pressure gas storage cylinder in or on the backpack of the diver. As the counterlungs inflate the metering bellows are squeezed and gas expelled through the non return valve 106 into the double counterlung. A weight 107 is shown attached to the hinged plate 108 of the counterlung.

This mechanism therefore supplies gas at a volume flow that is 3% of the rate at which the diver is breathing so that the harder the diver breathes the more gas is added. Once the diver has reached the planned depth the mass flow of added oxygen exceeds what the diver will be using up with the excess being vented from the circuit.

Should the counterlungs be empty the counterlung diaphragm presses and opens on the diaphragm of the demand regulator so that breathing gas can be added to inflate the supply counterlung. When in rebreather mode this adds more gas to the circuit, and ensures that there is sufficient gas in the rebreather circuit when the rebreather is first activated (i.e. the umbilical connection is turned off). The arrangement also allows top up the rebreather circuit if more gas is lost from the system than is being added by the metering pump.

At shallower depths, i.e. during descent and decompression, the oxygen added in this way may be insufficient to match the respiration demand of the diver, so additional oxygen needs to be added to the circuit. With reference to FIG. 20, this is supplied from a storage cylinder of pure oxygen with a pressure regulator set to deliver at a constant absolute pressure regardless of the diver's ambient pressure. The storage cylinder is mounted in or on the backpack.

A control valve comprises a body 110 having a diaphragm 111 closing a sealed chamber 112, and biased by a coiled compression spring 113 within the chamber 112. The body further defines a valve seat 114 and a poppet valve 115 movable off the seat 114 by movement of the diaphragm 111. An inlet connection 116 to the oxygen storage cylinder is upstream of the valve 115, and a connection 117 to the breathing gas circuit is on the downstream side of the valve 115. A restrictor 118 is provided in the connection 117.

The chamber 112 provides a constant reference pressure so that as the diver rises, and pressure in the breathing circuit reduces, a point is reached at which the force from the spring 113 overcomes the pressure in the breathing circuit and moves diaphragm 111 away from the chamber 112 to admit oxygen past the valve seat 114 into the connection 117. The restrictor 118 ensures that oxygen flow is controlled. The reference pressure in the chamber 112 is kept as low as is practical, preferably a vacuum, to minimise the amount that the pressure changes with changes in temperature.

As the diver's depth decreases the difference between the regulated pressure and the reference pressure increases causing the flow of oxygen to increase correspondingly. The maximum flow of oxygen added in this way occurs when the diver is at the surface. As the depth increases the flow reduces until the flow stops when the diver's ambient pressure equals or exceeds the reference pressure. This depth is set to match the depth at which the metering pump of FIGS. 18-19 is delivering sufficient oxygen, typically 70 m depth.

The volume of gas in the breathing circuit slows down any changes in the percentage of oxygen so that short term changes in the rate at which oxygen is added or used up will have little impact on the concentration of oxygen breathed. For example a diver breathing at 40 liters per minute from a 10 liter volume would take 5 minutes to drop the oxygen partial pressure from 1.0 bar to 0.2 bar if not oxygen was being added.

An accumulator as shown in FIG. 21, stores around 1 liter of gas between breaths and releases it during the short periods of inhalation when the maximum flow from the supply hose is less than that demanded by the diver. The accumulator is refilled during exhalation. Such an accumulator can help meet maximum demand when the diver is using the open circuit regulator backup circuit, and the supply hose has the reduced diameter bore made possible by the use of a counterlung in the primary breathing circuit. The use of an accumulator on the backpack is however useful in other kinds of surface supply diving systems to reduce the internal bore the diving hoses and/or the pumping pressure, particularly where the hoses are long and narrow so that the pressure drop due to flow effects is significant.

The accumulator comprises a body 120 having two chambers 121, 122 separated by a piston 123 that is sealed by a rolling diaphragm 124. One chamber is connected to the gas supply via port 125 and the other is open to the ambient pressure. The piston 123 is held in alignment by a guide rod 126. A spring 127 loads the piston so that the gas in the chamber 121 is maintained at a high enough pressure for the diver's demand regulator to operate.

When a demand regulator is used as a backup to the double counterlung described in WO89/01895 A1 an umbilical shut-off valve a, c as shown in FIG. 22 is closed when the open circuit regulator 89 is in use to prevent the supply gas being pumped into the counterlung 85, 86. This allows the pressure in the supply hose and the accumulator to build up sufficiently for the open-circuit demand regulator 89 to operate satisfactorily at peak flow rate.

The accumulator 120 is preferably incorporated into or mounted upon the backpack of the diver.

The invention claimed is:

1. Double counterlung breathing apparatus for a diver submerged beneath the surface of a body of water while being supplied with breathing gas from a breathing circuit, the double counterlung breathing apparatus comprising:

a double counterlung forming a first part of the breathing circuit and configured to be carried by the submerged diver, the double counterlung having a supply chamber and a return chamber that are connected for inflation and deflation in unison;

equipment that forms a second part of the breathing circuit and reprocesses the breathing gas expelled by the diver and pumps the reprocessed gas back to the diver, the equipment being disposed apart from and remote from the double counterlung;

the equipment including a gas compressor that is configured for pumping breathing gas to the double counterlung;

the equipment including a gas reprocessing unit that is configured for removing carbon dioxide expelled by the diver to the double counterlung and for maintaining the required partial pressure of oxygen in the breathing gas to be supplied to the double counterlung;

a supply duct that forms a third part of the breathing circuit extending between the equipment and the double counterlung and that carries to the double counterlung, breathing gas pumped from the equipment for the diver's breathing;

wherein the double counterlung further being configured to shut off the supply duct when the double counterlung reaches its maximum volume causing a rapid increase in the pressure of the gas in the supply duct;

a return duct that forms a fourth part of the breathing circuit extending between the equipment and the double counterlung and that carries back to the equipment for reprocessing, breathing gas expelled by the diver to the double counterlung during the diver's respiration;

wherein the double counterlung further being configured to shut off the return duct when the double counterlung reaches its minimum volume causing a rapid drop in the pressure of the gas in the return duct;

the equipment including a first detector that upon detecting the minimum volume of said double counterlung signals the equipment to add breathing gas to said return duct, said first detector being positioned upstream of said compressor, said first detector including an inlet regulator responsive to the rapid drop of pressure in said return duct caused by the return duct being shut off at the double counterlung, to add breathing gas to said return duct, but said first detector not being responsive to slow reductions in pressure caused by the double counterlung moving toward reduced depths beneath the surface of the body of water; and the equipment including a second detector that upon detecting the maximum volume of said double counterlung signals the equipment to vent breathing gas from said supply duct, said second detector being positioned downstream of said compressor in use, said second detector including an outlet regulator responsive to the rapid increase of pressure in said supply duct caused by the supply duct being shut off at the double counterlung, to vent breathing gas from said supply duct, but not responsive to the slow increase in pressure caused by the double counterlung moving toward increased depths beneath the surface of the body of water.

2. Double counterlung breathing apparatus according to claim 1, wherein said inlet regulator responsive to a rate of change of pressure in said return duct comprises an inlet valve and an inlet chamber, said inlet valve and inlet chamber being divided by a first actuating element, the first actuating element having two sides, one side of said first actuating element being connected to said return duct, the other side of said first actuating element being connected to said return duct via a first flow restrictor, and said inlet valve being opened upon movement of said first actuating element in response to a pressure differential in said inlet chamber as a result of reducing pressure in said return duct.

3. Double counterlung breathing apparatus according to claim 2, wherein a damping volume is provided between said first flow restrictor and said first actuating element.

4. Double counterlung breathing apparatus according to claim 2, wherein said first actuating element comprises a diaphragm.

5. Double counterlung breathing apparatus according to claim 1, wherein said outlet regulator responsive to a rate of change of pressure in said supply duct comprises a vent valve having a vent chamber, said vent valve and vent chamber being divided by a second actuating element, the second actuating element having two sides, one side of said actuating element being connected to said supply duct, the other side of said actuating element being connected to said supply duct via a second supply flow restrictor, and said vent valve being opened upon movement of said second actuating element in response to a pressure differential in said vent chamber as a result of increasing pressure in said supply duct.

6. Double counterlung breathing apparatus according to claim 5, wherein a damping volume is provided between said second supply flow restrictor and said second actuating element.

7. Double counterlung breathing apparatus according to claim 5, wherein said second actuating element comprises a diaphragm.

8. Double counterlung breathing apparatus according to claim 1, wherein said first detector and said second detector are provided in a common housing.

9. Double counterlung breathing apparatus according to claim 8, wherein said common housing defines a portion of said return duct and a portion of said supply duct.

10. Double counterlung breathing apparatus according to claim 1, and further including an accumulator for collecting breathing gas vented from said breathing circuit.

11. Double counterlung breathing apparatus according to claim 1, wherein the double counterlung having three breathing circuits comprising a gas reclaim circuit, a rebreather circuit and an open demand circuit, wherein one of said breathing circuits is selectable on demand by operation of a plurality of on/off valves, and wherein a plurality of said on/off valves is connected for operation by a common actuator.

12. Double counterlung breathing apparatus according to claim 1, wherein said compressor is a hybrid gas compressor, said hybrid gas compressor comprising an ejector pump and in series therewith a centrifugal compressor, said ejector pump being a first stage, and said centrifugal compressor being a second stage, wherein said centrifugal compressor is substantially over-sized so that an excess output thereof comprises motive gas for said ejector pump.

13. Double counterlung breathing apparatus according to claim 1, and comprising a rebreather for use by the diver, said rebreather comprising two independent means of adding oxygen to said breathing circuit, a first means being adapted to add an oxygen-rich gas mix as a proportion of the breathing rate of the diver, and a second means being adapted to add oxygen at less than a pre-determined diving depth.

14. Double counterlung breathing apparatus according to claim 1, and further comprising an accumulator for breathing gas, said accumulator being connected to a second supply duct for an open circuit demand regulator of said double counterlung.

* * * * *